US007117645B2

(12) United States Patent
Bzorgi

(10) Patent No.: US 7,117,645 B2
(45) Date of Patent: Oct. 10, 2006

(54) RAPID DEPLOYMENT SHELTER SYSTEM

(75) Inventor: Fariborz M. Bzorgi, Concord, TN (US)

(73) Assignee: BWXT Y-12, L.L.C., Oak Ridge, TN (US)

( * ) Notice: Subject to any disclaimer, the term of this patent is extended or adjusted under 35 U.S.C. 154(b) by 0 days.

(21) Appl. No.: 10/138,147

(22) Filed: May 3, 2002

(65) Prior Publication Data

US 2006/0185709 A1 Aug. 24, 2006

(51) Int. Cl.
*E04H 1/00* (2006.01)

(52) U.S. Cl. ..... 52/79.5; 52/68

(58) Field of Classification Search ..... 52/66, 52/68, 69, 71, 79.5; 135/143, 121, 95, 87
See application file for complete search history.

(56) References Cited

U.S. PATENT DOCUMENTS 2,765,499 A * 10/1956 Couse ..... 52/66
2,832,637 A * 4/1958 Decosse ..... 296/26.15
2,904,850 A * 9/1959 Couse et al. ..... 52/36.2
4,534,141 A * 8/1985 Fagnoni ..... 52/68
4,780,996 A 11/1988 Julien, Jr.
5,461,832 A 10/1995 Smith
5,596,844 A 1/1997 Kalinowski
5,732,839 A 3/1998 Schimmang et al.
5,761,854 A 6/1998 Johnson et al.
5,916,096 A 6/1999 Wiesmann et al.
5,966,956 A * 10/1999 Morris et al. ..... 62/259.1
6,223,479 B1 * 5/2001 Stockli ..... 52/68
6,253,498 B1 7/2001 Fanucci

OTHER PUBLICATIONS

U.S. Army Soldier and Biological Chemical Command, "International Organization for Standardization Shelters (ISO Shelters)," Feb. 3, 2001, World-Wide-Web page http://www.sbccom.army.mil/products/shelters/ISO.htm.
- - - , "Hospital in a Box," *Popular Science*, Dec. 1998.

* cited by examiner

*Primary Examiner*—James O. Hansen
(74) *Attorney, Agent, or Firm*—M. J. Renner; Luedeka, Neely & Graham, P.C.

(57) ABSTRACT

A shelter for the protection of for the protection of persons, animals, equipment, materials, property, and similar things of value from potentially damaging environmental conditions is disclosed. Various embodiments include the use of a frame structure and hinged panels which are unfolded to create the walls of the structure. Optionally flexible surfaces may be added to the ends of the shelter to at least partially close the end of the shelter.

20 Claims, 13 Drawing Sheets

RAPID DEPLOYMENT SHELTER SYSTEM

The U.S. Government has rights to this invention pursuant to contract number DE-AC05-00OR22800 between the U.S. Department of Energy and BWXT Y-12, L.L.C.

FIELD OF THE INVENTION

This invention relates to shelter systems for the protection of persons, animals, equipment, materials, property, and similar things of value from potentially damaging environmental conditions.

BACKGROUND

Shelter systems are typically characterized as permanent or temporary. The distinction between the two is based upon such factors as the intended duration of use, the mobility of the device, and the durability of construction, but there is no absolute discriminator for what constitutes a permanent shelter versus a temporary one. However, by way of example, conventional "brick and mortar" or wooden frame buildings are generally thought of as permanent shelters. Tents and "lean-to's" are generally thought of as temporary shelters. Tents are generally made of fabric or non-woven materials, and may be supported by mechanical poles, air columns, or air pressure. Temporary shelters are used by the military, for example, for shelters and hospitals for rapidly moving troops. It is desirable that temporary shelters can collapsed, stored and transported in configurations which constitute less physical volume that the volume available inside the shelter when it is deployed. It is also desirable that temporary shelters be set up and torn down in a minimal amount of time.

SUMMARY

Many of the foregoing and other needs are met by a system which in the preferred embodiment includes a frame formed by frame members that include two end-frames that define opposing ends of the frame. Each end-frame has a top member, and the frame defines a volume of space. A longitudinal beam is positioned between the end-frames and is fixedly connected to each top members such that the beam does not move relative to the end-frames. The system also includes panels for forming two generally upright sides, two floor sections and two roof sections. The panels are stowed essentially within the volume of space defined by the frame. Hinges connect the panels and the longitudinal beam into a continuous folding structure. The continuous folding structure is configured for folding into a storage position and for unfolding into a deployed position while maintaining the panels in the continuous folding structure without detaching the panels and without translocating the longitudinal beam. In an alternate embodiment the end of the volume of space defined by the panels may be at least partially closed by a flexible surface that is attached to the ends of at least two panels when the panels are unfolded. In a further variation a flexible surface is attached to the end of at least one panel and to the end-frame that is proximate to the end of the at least one panel to at least partially close the volume of space defined by the panels when they are unfolded.

In another embodiment a passageway is provided through a portion of the volume defined by the panels when they are folded within the frame such that one or more persons may enter the passageway and unfold the panels from within the passageway.

In different embodiments a passageway is provided through a portion of a volume of space defined by the panels when they are stowed essentially within the volume of space defined by said frame such that one or more persons may enter the passageway and unfold said panels from within said passageway.

Some embodiments employ a latch mechanism for securing at least one panel to the frame when the panels are unfolded to hold the panels in a secure unfolded position. Some embodiments also employ mechanical systems for unfolding the panels.

Additional features that may be added in alternate embodiments include a hoist and cable system for controlling and lowering the panels as they rotate and unfold around their attached hinges. An actuator may be added to assist in raising at least some of the panels to form a roof for the shelter.

In a further embodiment a shelter includes a frame that has two polygon end-frames defining a volume of space and each end-frame having at least a top member and two vertical members. The polygon end-frames are preferably fixedly connected together by at least one longitudinal beam such that the end-frames are opposed to each other and the at least one longitudinal beam does not move relative to the end-frames. A bottom panel extends between the end-frame. Two top panels are provided with each top panel having one side hinged to the at least one longitudinal beam and each top panel having an opposed longitudinal side. The embodiment further incorporates two tri-fold sections each having three contiguously hinged panels stowed essentially between the end-frames. One side of each tri-fold section is hinged to one side of the bottom panel, and the other side of each tri-fold section is hinged to a top panel longitudinal side.

In alternate embodiments there is a frame consisting of polygon end-frames having at least a top member and two vertical members. The polygon end-frames are preferably fixedly connected together by at least one longitudinal beam such that the end-frames are opposed to each other. A bottom panel extends between the end-frames. Two top panels are provided with each top panel having one side hinged to the at least one longitudinal beam and each top panel having an opposed longitudinal side. A floor panel with first and second sides is provided where the first side is hinged to the bottom panel where it can rotate between a vertical and horizontal position. There is an upright wall portion fixedly attached to the second side of the floor panel and extending obliquely to the floor panel. The upright wall panel has a second side disposed from the side attached to the floor panel. There is a wall panel with first and second sides where the first side is hinged to the second side of the upright wall portion in a manner that permits rotation between a position parallel to the floor panel and a position extending obliquely with respect to the floor panel thereby forming a wall for the shelter. A roof panel is provided with first and second sides where the first side is hinged to the second side of the wall panel and also hinged to the second side of the roof panel in a manner that permits motion between a position parallel to and adjacent to the wall panel and a position oblique to the wall panel and substantially parallel to the floor panel while spaced apart from the floor panel so as to form a roof for the shelter.

In other embodiments the shelter may incorporate a cable system with cables for lowering and raising the floor panel between vertical and horizontal positions, and a hoist attached to the cable system for extending and retracting cables of the cable system to raise and lower the floor panel.

The hoist may be mounted on the floor panel adjacent to the upright wall. The shelter may include an actuator to raise and lower the wall panel and the roof panel. In some embodiments incorporating three contiguously hinged panels in tri-fold sections, one of the hinged panels includes a floor surface. Some embodiments incorporating three contiguously hinged panels may include a flexible surface connected to the ends of at least two contiguously hinged panels. Such shelters may also include a passageway through a portion of the volume of space defined by the tri-fold sections, and may incorporate a latch mechanism for securing at least one contiguously hinged panel.

BRIEF DESCRIPTION OF THE DRAWINGS

Referring now to the drawings in which like reference characters designate like or corresponding parts throughout the several views, there are shown several embodiments of the invention. It will be understood that the various embodiments shown are intended as examples and do not limit the scope of the invention.

DETAILED DESCRIPTION OF PREFERRED EMBODIMENTS

Described next are several embodiments of this invention from which modifications will be apparent to those skilled in the art without departing from the metes and bounds of the invention.

EXAMPLE

Figure 1:
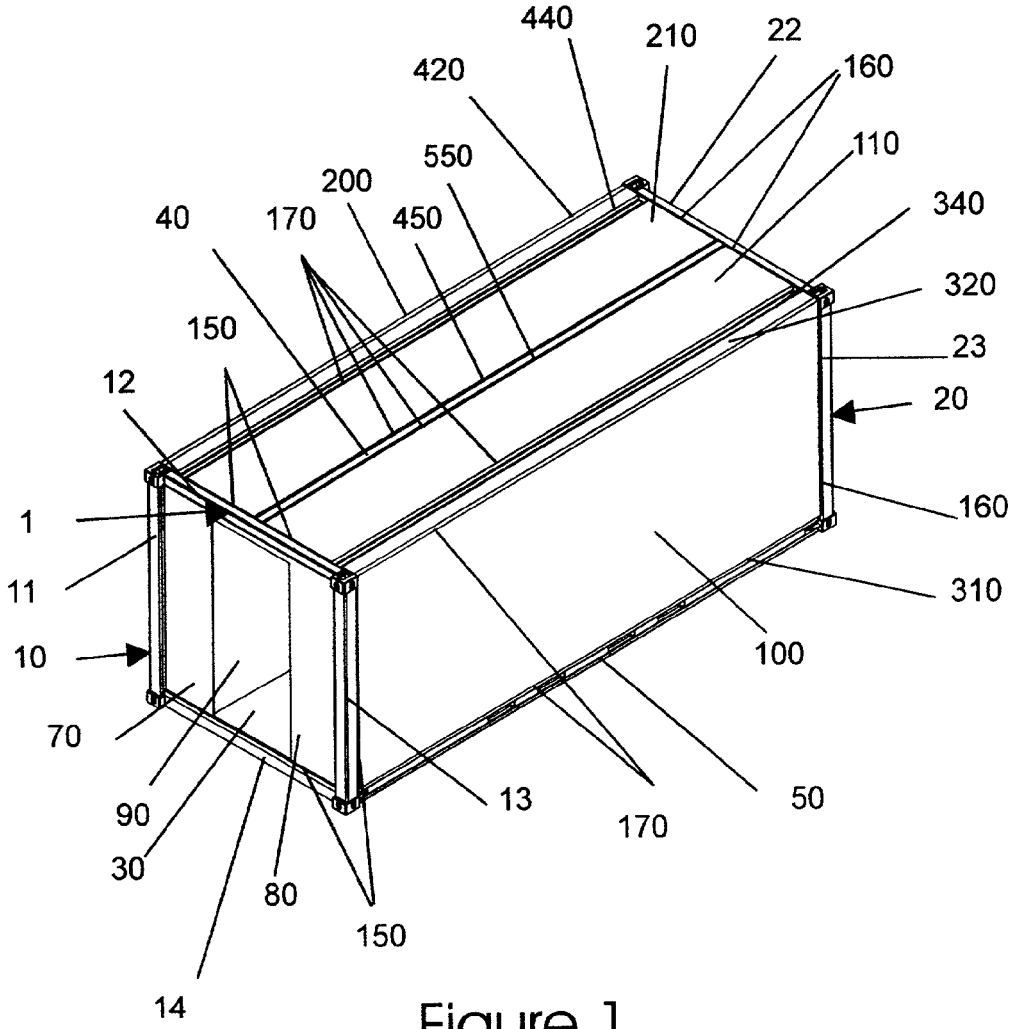
FIG. 1 illustrates a shelter folded for storage or transport.

In one embodiment illustrated in FIG. 1 the shelter includes panels 30, 110, and 210, and a tri-fold section 100 and an opposing tri-fold section 200 and a frame 1. In the preferred embodiment the frame 1 incorporates two essentially square opposing end-frames 10 and 20. In alternate embodiments these end-frames 10 and 20 could be triangular or polygonal. The end-frames 10 and 20 establish what are called for definitional purposes the "ends" of the shelter. The "ends" 150 and the opposing "ends" 160 of shelter panels 30, 110, and 210, and the "ends" of the tri-fold section 100 and the "ends" of the opposing tri-fold section 200 are the edges of the shelter panels 30, 110, and 210, and the edges of the tri-fold section 100 and the edges of the opposing tri-fold section 200 which are located proximate to the end-frames 10 and 20 respectively. In this embodiment the frame 1 further incorporates a longitudinal beam 40 in a manner that positions the end-frames 10 and 20 such that they are parallel to each other. The longitudinal beam 40 establishes what is called for definitional purpose the "longitudinal" dimension of the shelter. The "sides" 170 of the shelter panels 30, 110, 210, and the sides of the tri-fold section 100, and the sides of the opposing tri-fold section 200 are the edges of the shelter panels 30, 110, 210, and the edges of the tri-fold section 100 and the edges of the opposing tri-fold section (200 in FIG. 2) that run parallel to the longitudinal beam 40. In the preferred embodiment shown in FIG. 1 the end-frames 10 and 20 are further joined together by an additional longitudinal beam 50, and an additional longitudinal beam (not visible) which extends from the lower left corner of end-frame 10 to the lower left corner of end-frame 20. A bottom panel 30 connects the bottom member 14 of end-frame 10 and the corresponding bottom member (not visible) of the opposing end-frame 20. Bottom member 14 may be a separate frame structure or it may be provided by the bottom panel 30. In the preferred embodiment the bottom panel 30 is constructed as a rigid structure such as honeycomb material with rigid framing.

In the preferred embodiment, two tri-fold sections 100 and 200 are installed vertically as shown. Each tri-fold section 100 and 200 consists of three panels (101, 102, 103 and 201, 202, 203, respectively, in FIG. 2) that are connected by two longitudinal hinges (320, 330 and 420, 430, respectively, in FIG. 2) like a tri-fold room divider. Each tri-fold section 100 and 200 (in FIG. 2) may be collapsed accordian-like into a flat package as shown in FIG. 1. One free longitudinal side 170 of each tri-fold section 100 and 200 (in FIG. 2) is connected by a hinge (310 or 410, respectively in FIG. 6) to the bottom panel 30. Optionally, in an alternate structure, the bottom panel 30 attaches to a longitudinal beam (for example 50) and the free side 170 of each tri-fold section 100 and 200 hinges to the same longitudinal member (for example 50).

Figure 6:
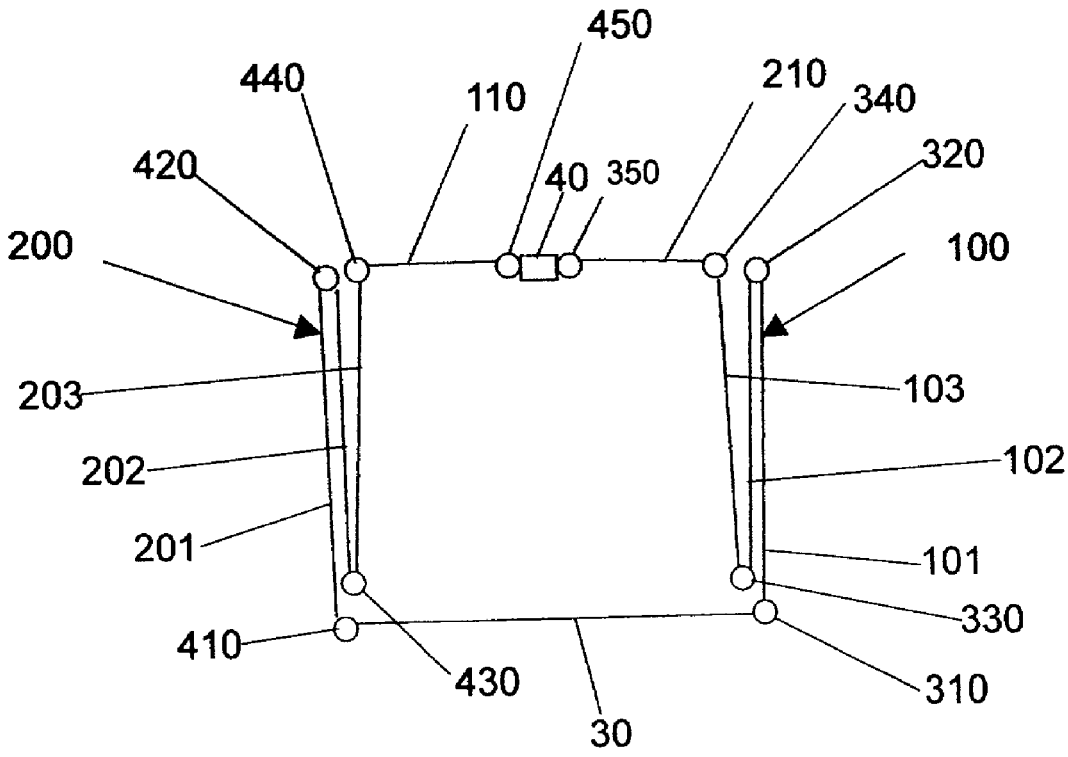
FIG. 6 is a schematic of the end view of a shelter folded for transportation or storage.

In the preferred embodiment shown in FIG. 1, the side 170 of each tri-fold section (for example 100) that is not attached to the bottom panel 30 is connected by a hinge (for example 340) to a top panel (for example 110). The corresponding feature (on the opposite side of the shelter) in this example is a tri-fold section 200 which is connected by a hinge 440 to the other top panel 210. In the preferred embodiment the hinges 340 and 440 are constructed as illustrated in FIG. 6. In an alternate embodiment the hinges 340 and 440 are constructed as standard mechanical hinges. In this example the top panels 110 and 210 are each each connected by a hinge, 350 and 450 respectively, to a longitudinal frame beam 40 that is orthogonal to the end-frame elements. In the preferred embodiment the hinges 350 and 450 are constructed as illustrated in FIG. 6. In an alternate embodiment the hinges 350 and 450 are constructed as standard mechanical hinges.

Further mechanical stability and functionality may be established by adding end panels 70 and 80 as illustrated. In addition, interior equipment such as cabinet 90 may be added. Note that a passageway (60 in FIG. 2) through at least a portion of the stowed configuration is defined by the boundaries established by the bottom panel 30, the cabinet 90, the interior vertical surface parallel to cabinet 90 (not visible from this angle) and top panels 210 and 110. This passageway (60 in FIG. 2) may be used by a person to enter the stowed configuration and deploy the shelter from the interior.

Figure 2:
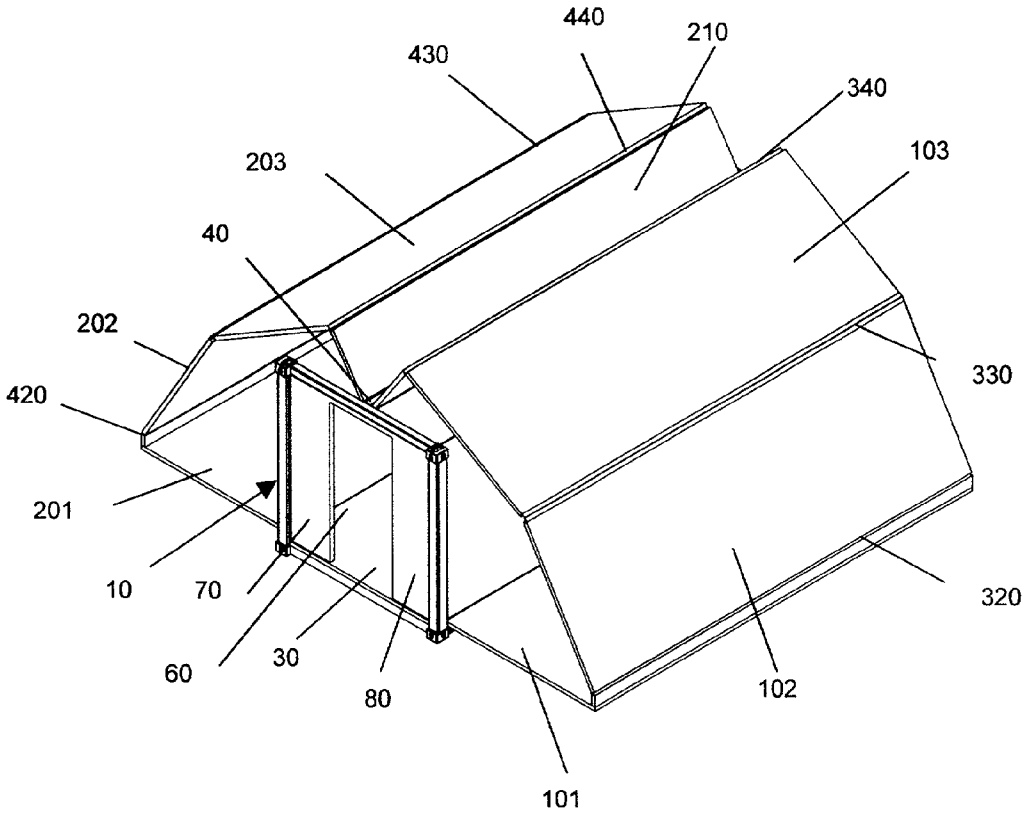
FIG. 2 illustrates as shelter being unflolded for deployment.

FIG. 2 illustrates an intermediate stage of deployment of a preferred embodiment. Here the tri-fold section 100 shown FIG. 1 is unfolding as its three constituent panels 101, 102, and 103. The tri-fold section 200 in FIG. 1 is unfolding as its three constituent panels 201, 202, and 203. In a preferred embodiment panels 101 and 201 are constructed as rigid structures such as honeycomb material with rigid framing, since they constitute part of the floor of the shelter. In a preferred embodiment panels 70, 80, 110, 210, 102, 103, 202, and 203 incorporate a protective material which is resistant to puncture by sharp instruments, bullets, flying debris, projectiles, and similar hazards. Such protective material may consist of high strength fabric, metallic or ceramic armor, or similar materials. Interior cabinet 90 (in FIG. 1) is not depicted for this FIG. 2.

Figure 3:
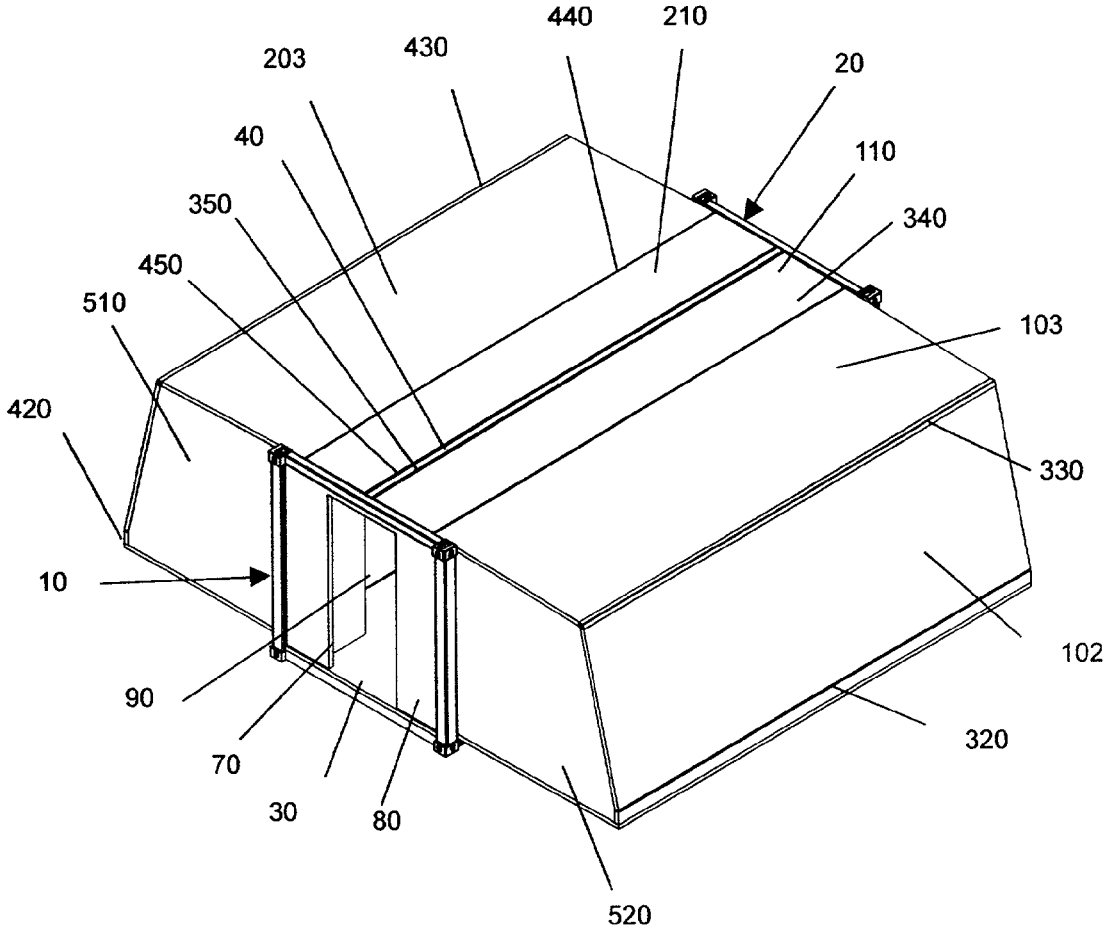
FIG. 3 illustrates a fully deployed shelter

FIG. 3 illustrates a preferred embodiment of the fully-deployed shelter. Hinges 320 and 330 are shown connecting the three panels 101, 102, 103 in FIG. 2 that comprise the tri-fold panel section 100 shown in FIG. 1. In the preferred embodiment the hinges 320 and 330 are constructed as illustrated in FIG. 6. In an alternate embodiment the hinges 320 and 330 are constructed as standard mechanical hinges. In a preferred embodiment the top panels 110 and 210 are latched to the end-frame top members (12 and 22 in FIG. 1) when the shelter is fully unfolded. Such latching adds rigidity to the overall structure.

In FIG. 3 flexible surfaces 510 and 520 are shown attached to panels 201, 201, 203, 70 and 101, 102, 103, 80 respectively. Such flexible surfaces could be manufactured from fabric, plastic, or non-woven materials, for example. In the preferred embodiment these flexible surfaces 510 and 520 are constructed of butyl rubber. This permits them to fold and stretch as the shelter is deployed or collapsed for storage and transport. In a further variation the flexible surfaces 510 and 520 could be attached to one or more panels 201, 201, 203 or 101, 102, 103, and to the end-frame 10. In FIG. 3 the flexible surfaces 510 and 520 are shown covering the complete end of the shelter outside the end-frame area. This is the preferred embodiment where complete isolation from nuclear, biological and chemical contaminants in the enviroment is needed within the shelter. In some alternate applications it is desirable and it is possible to cover only a portion of the end.

Figure 4:
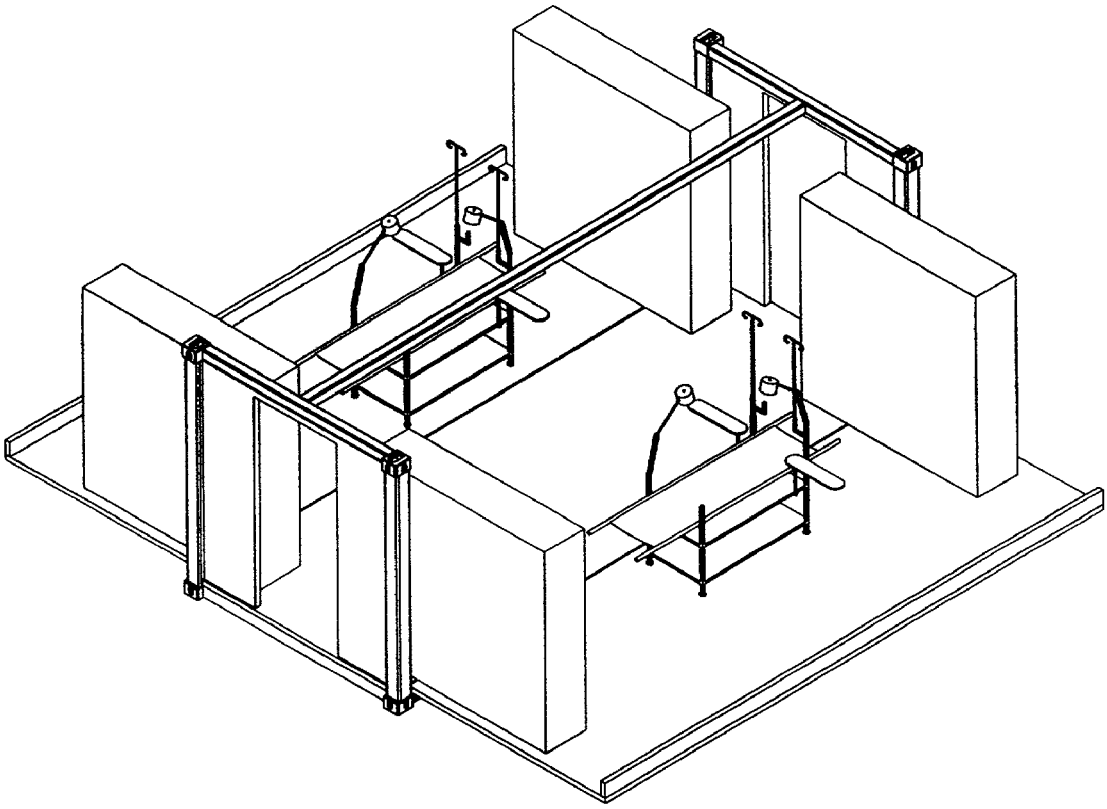
FIG. 4 is a cut-away drawing showing an embodiment where shelter is used for a field surgical suite.

FIG. 4 illustrates a cut-away version of a further embodiment where the interior is equipped as a mobile surgical suite.

Figure 5:
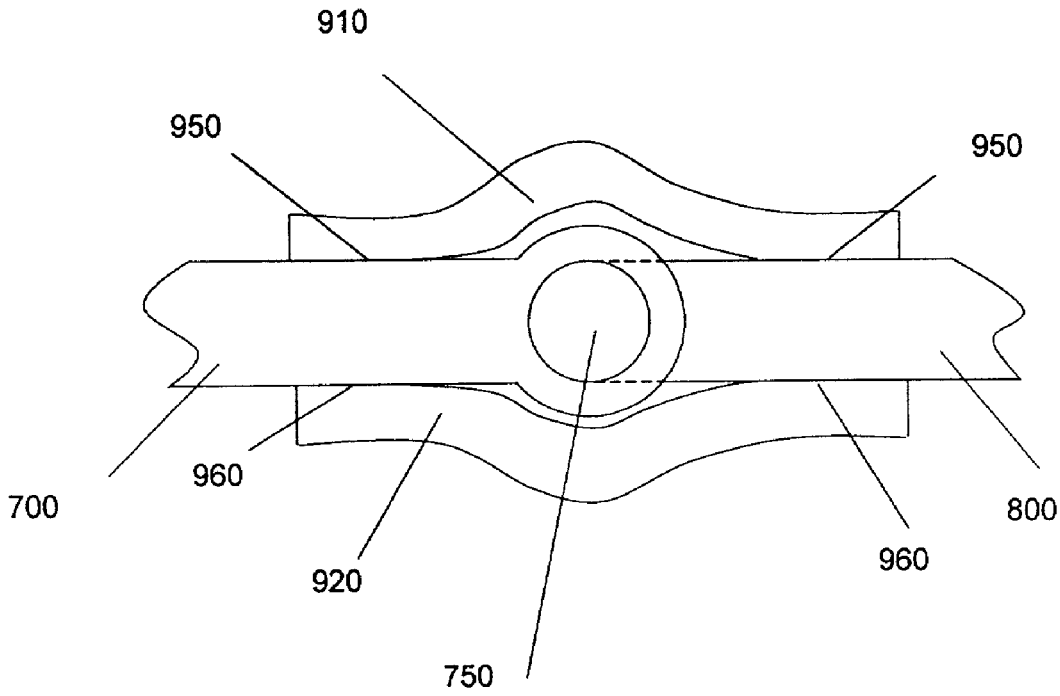
FIG. 5 is an end-view of a sealed hinge.

FIG. 5 illustrates one embodiment of a sealed hinge. The female flange 700 is attached to one panel and the male flange 800 is attached to the adjoining panel. A flexible exterior cover 910 is positioned across the joint 750 of the hinge and sealed by adhesive or alternate fastening mechanims at points 950. For additional protection an interior cover 920 may be added as illustrated and sealed by adhesive or alternate fastening mechanisms at points 960. I a preferred embodiment the covers 910 and 920 are fabricated from butyl rubber.

Referring now to FIGS. 6, 7, 8, and 9 the method of assembling the shelter will be described. FIGS. 6, 7, 8, and 9 schematically illustrate a cross sectional side view of the panels 30, 101, 102, 103, 110, 210, 201, 202, and 203, and the hinges 310, 320, 330, 340, 350, 450, 440, 430, 420, and 410. The dimensions of items shown are increased and decreased to aid the clarity of the illustration, and particularly, the hinges 310, 320, 330, 340, 350, 450, 440, 430, 420, and 410 are greatly magnified. The shape of the panels has been simplified and the width dimension shrunk to zero.

FIG. 6 illustrates the position of the panels 30–203 when they are in the fully folded position ready for shipping. The panels 101, 102, 103, 201, 202 and 203 are fully folded together in an approximately parallel relationship, and are substantially perpendicular to the panels 30, 110, and 210. To begin the process of erecting or unfolding the shelter, the panels 101 and 201 are lowered away from the center of the shelter until they assume the position shown in FIG. 7. By reference to FIGS. 6 and 7 it will be appreciated that the process of lowering and raising the panels 101 and 102 may be accomplished entirely by a person inside the shelter, and thus the shelter may be erected from the relative safety of the interior of the shelter. In the preferred embodiment, a hoist 105 and cable system 104 are provided for lowering and raising panel 101, and likewise a hoist 205 and cable system 204 are provided for raising and lowering panel 201. The hoists 105 and 205 are preferably secured to the outermost portions of panels 101 and 201, and the cable system is secured at anchors 106 and 206, which are stationary during the process of folding and unfolding the shelter. Preferably, the anchors 106 and 206 are formed on and are part of the end-frame 10.

Figure 7:
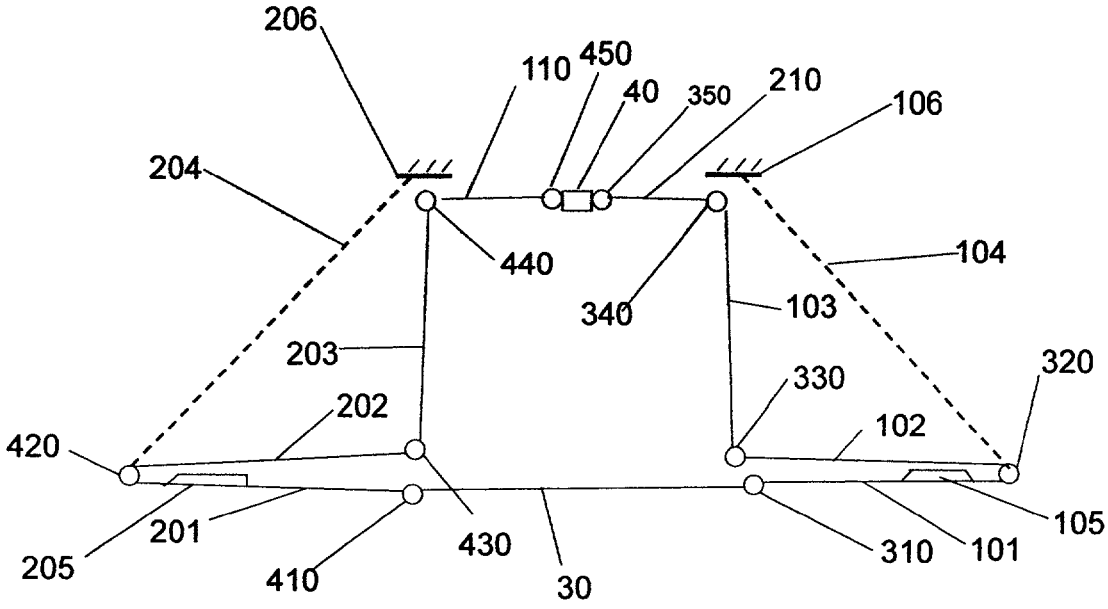
FIG. 7 is a schematic of the end view of a shelter as it is being unfolded for deployment.

As the panels 101 and 201 are lowered downwardly and outwardly, the panels 102 and 202 move outwardly and downwardly in unison, but the interior ends of the panels 102 and 202 move upwardly, and the magnitude of the upward movement is determined by the relative sizes of the panels. In FIG. 7, only very slight upward movement was experienced by the interior ends of the panels 102 and 202 because they were almost equal in their width dimension to the panels 101 and 102.

Figure 8:
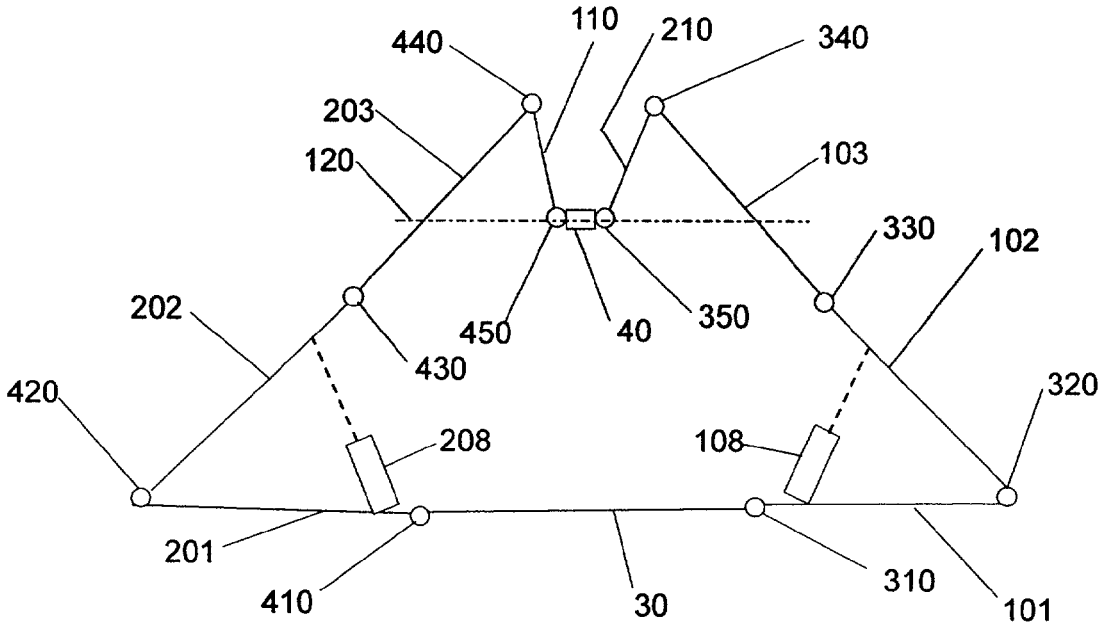
FIG. 8 a schematic of the end view of a shelter as it is further unfolded for deployment.
Figure 9:
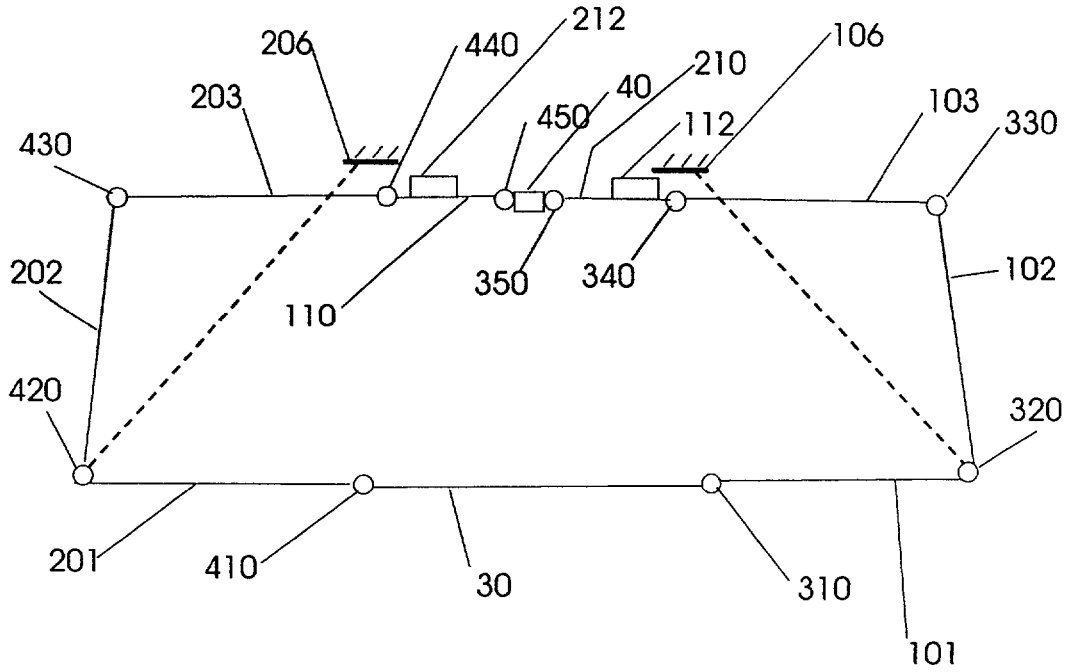
FIG. 9 is a schematic of the end view of a shelter as deployed.

To raise the panels from the position shown in FIG. 7 to the position shown in FIG. 9, actuator systems 108 and 208 are provided to raise the panels as schematically illustrated in FIG. 8. Once the panels are raised to the position shown in FIG. 9, it is preferred to leave the actuators 108 and 208 and the cable systems 104 and 204 in operable position to provide additional structural integrity and quick fold up capability. The primary stability of the shelter in the raised position is provided by latching the frame elements 10 to the panels. Preferably, the panels 110 and 210 are latched to the end-frame 10 as schematically illustrated in FIG. 9 by latch and anchor mechanisms 112 and 212.

Referring to FIGS. 7, 8 and 9 the need for a resilient cover for the ends of the shelter is illustrated. In the preferred embodiment, a flexible cover is continuously attached and sealed along the ends of the panels, covering at least a potion of the opening found at the end of the shelter. As the shelter moves from the position shown in FIG. 7 to the position of FIG. 8, the flexible cover will stretch because of the expansion of the area caused by the upward movement of the panels 110 and 210. The needed stretch is defined by the distance between the panels 110 and 210 and the dotted imaginary line 120 shown in FIG. 8. It has been found that butyl rubber sheets are suitable for use as the resilient material to extend between the ends of the panels because it can easily stretch with the motion of the panels as panels 110 and 210 move upwardly.

Figure 10:
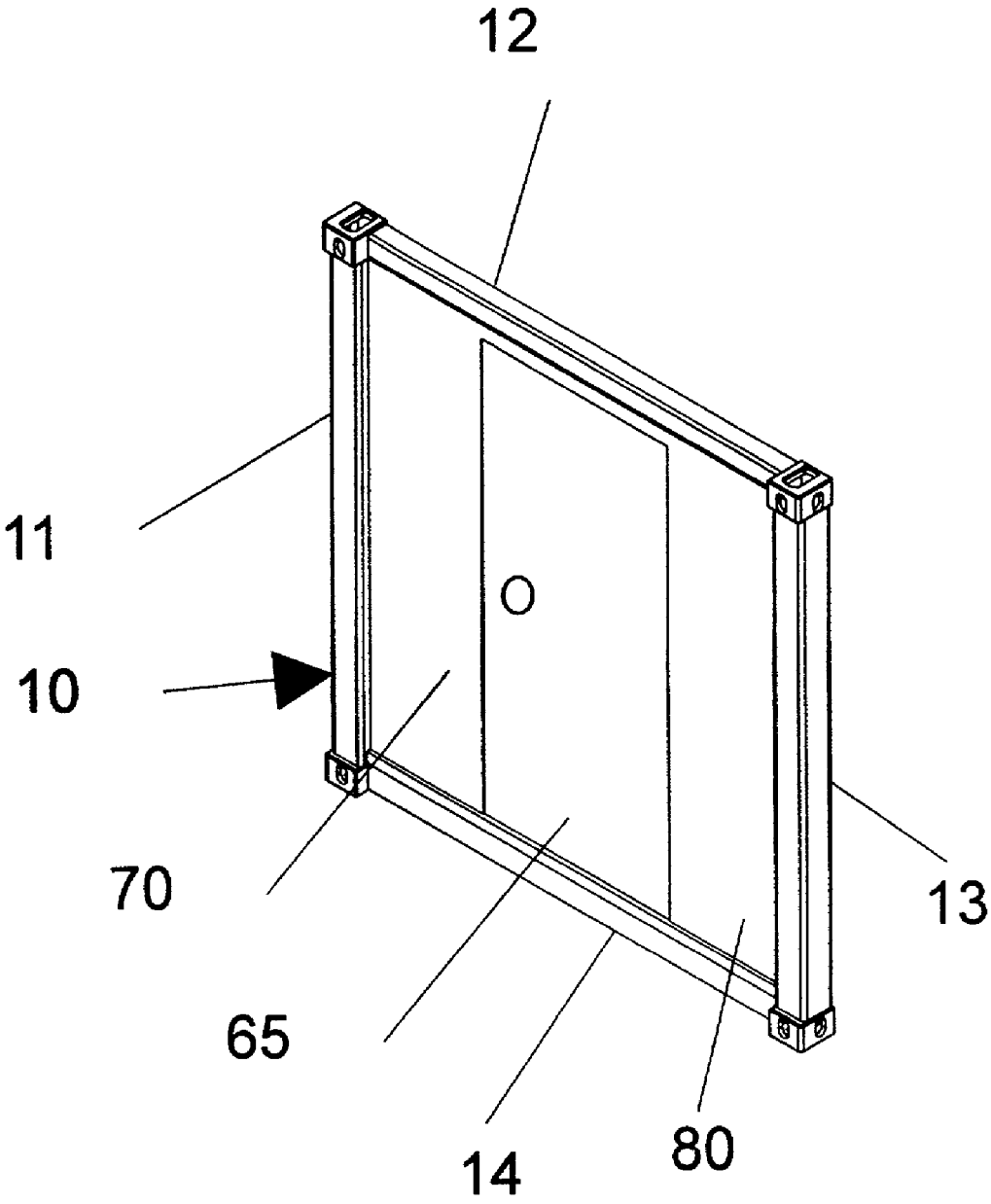
FIG. 10 is an illustration of the end of shelter showing a door to a passageway into the shelter.

FIG. 10 illustrates an embodiment where a door 65 is provided at the entrance of the passageway (60 in FIG. 2). In an application where complete isolation from nuclear, biological and chemical contaminants in the environment is needed within the shelter, the preferred embodiment is to have the door 65 sealed against panels 70 and 80 and against the end-frame members 12 and 14.

Figure 11:
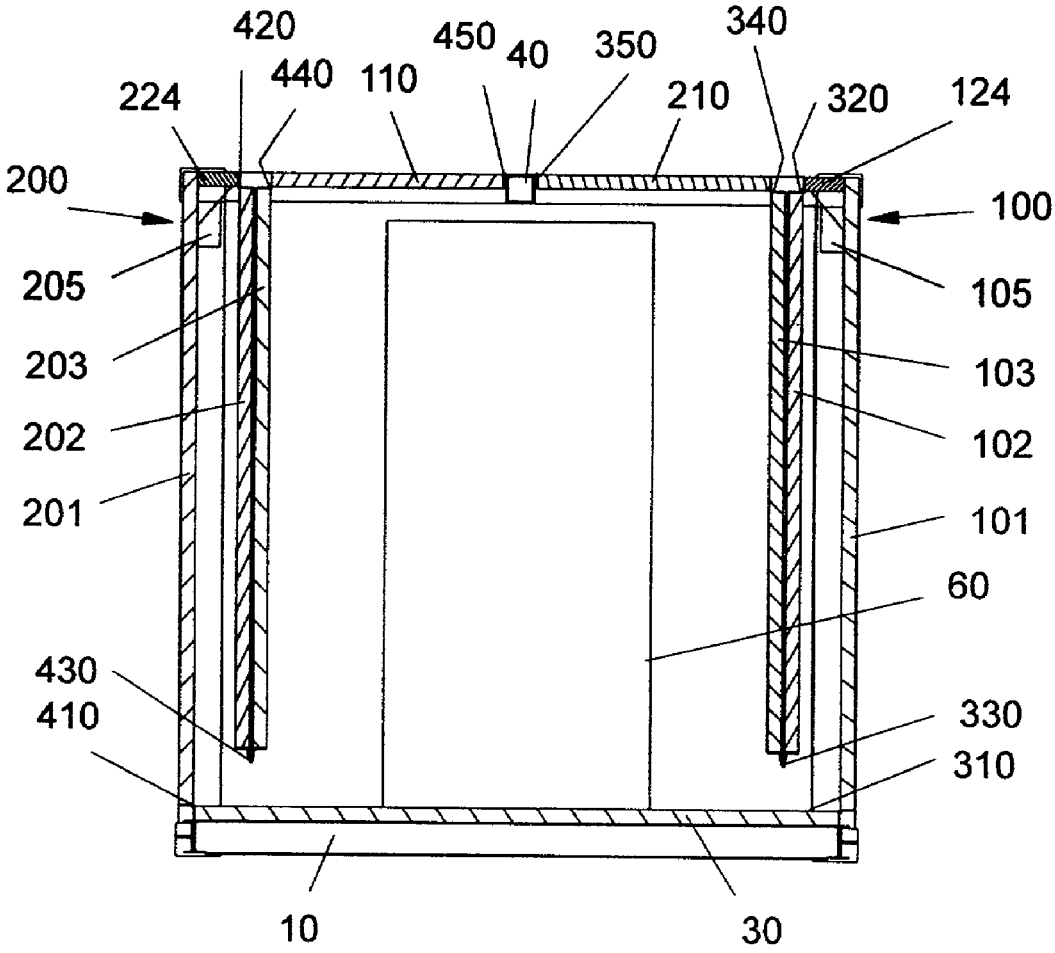
FIG. 11 is a cross-sectional view of a shelter folded for transportation or storage.
Figure 12:
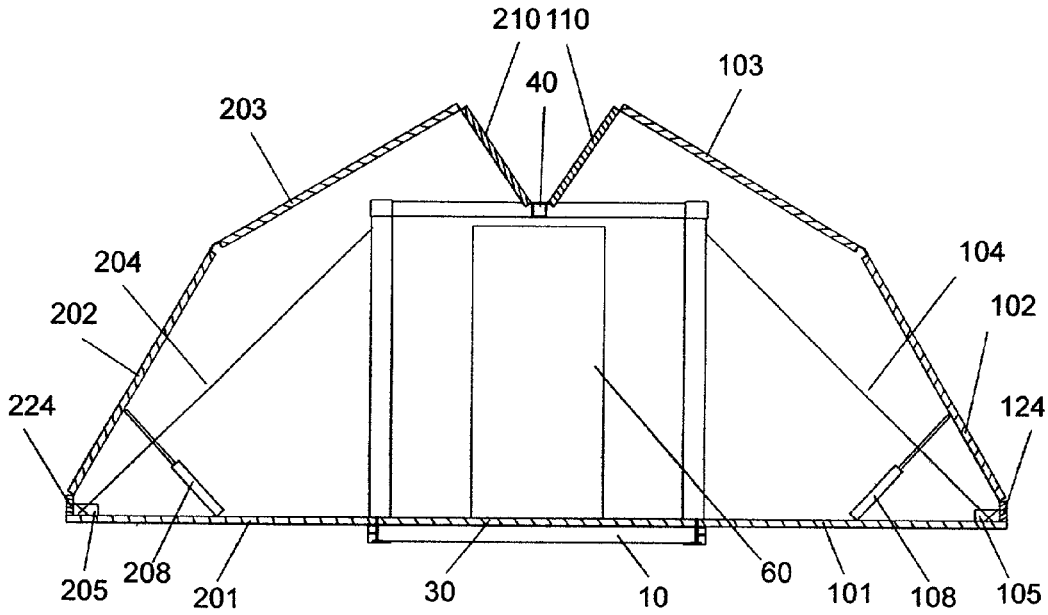
FIG. 12 is a cross-sectional view of a shelter as it is being unfolded for deployment.
Figure 13:
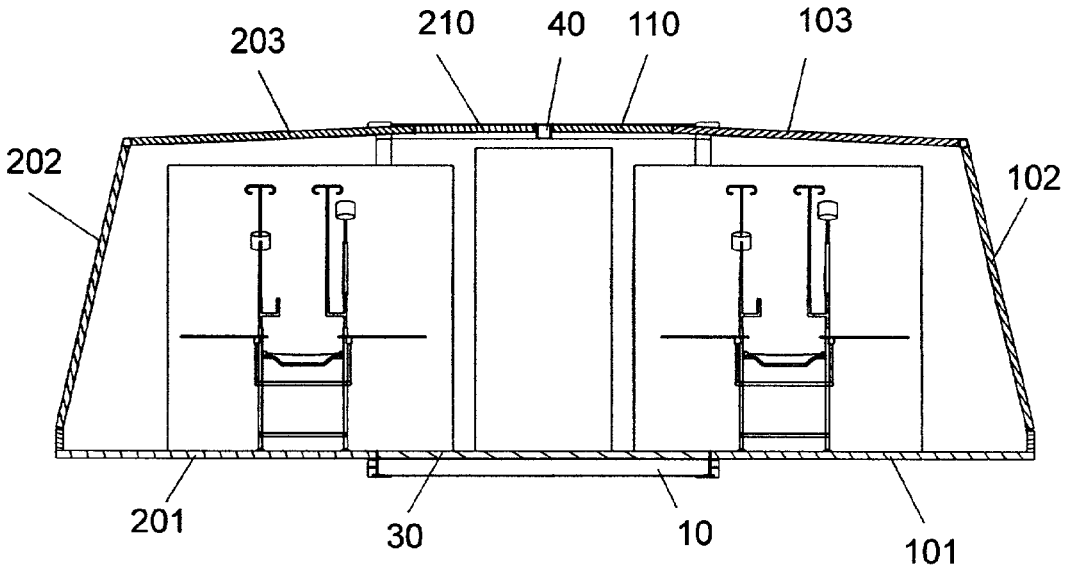
FIG. 13 is a cross-sectional view of a fully-deployed shelter, including equipment contained in the shelter.

FIGS. 11, 12 and 13 are somewhat diagrammatical cross sectional views of the shelter roughly corresponding to FIGS. 6, 8 and 9 respectively. FIGS. 11, 12 and 13 are more detailed and more realistic, but are still diagrammatic illustrations. FIG. 11 illustrates the shelter in the closed position, and in this embodiment short upright walls 124 and 224 are disposed on the outer sides of the panels 101 and 201, and enable the panels 102, 103, 202 and 203 to hang substantially vertically and provide a space between panels 101 and 102, and between 201 and 202. Thus, space is provided to mount the hoists 105 and 205 on the panels 101 and 201 without interfering with the other panels. The upright walls also provide rigidity and strength along the outer side of the panels 101 and 201 when functioning as a floor.

Referring to FIG. 12, the shelter is shown in a partially unfolded condition in which the actuators 108 and 208 are raising the panels 102, 103, 110, 210, 203, 202 to form sidewalls and a roof for the shelter. As the actuators continue to push the panels 102 and 202 outwardly and upwardly, the panels 103, 110, 210 and 203 will rotate and move downwardly to assume the position shown in FIG. 13.

The actuators 108 and 208 and the hoists 105 and 205 are preferably mounted so as to provide the least possible interference with the usefulness of the shelter. The cable system 104 is disposed on guides, preferably pulleys, and runs outside the ends of the panels 102, 103, 202 and 203. Thus, the presence of the cables does not interfere with the movement and rotation of the panels. Similarly, the actuators 108 and 208 are preferably mounted proximate the ends of the panels, and most preferably, an actuator 108 is mounted on both ends of panel 101, and an actuator 208 is mounted on both ends of panel 201. Likewise, while there is need of only one hoist 105 on panel 101 and one hoist 205 on panel 201, the cable system 104 extends upwardly at both ends of panels 101 and 201 as schematically shown in FIG. 12.

The foregoing description of certain embodiments of this invention has been provided for the purpose of illustration only, and various modifications may be made without affecting the scope of the invention as set forth in the following claims.

I claim:

1. A shelter comprising:

a frame formed by a plurality of frame members including two end-frames that define opposing ends of the frame, each end-frame having a top member, said frame defining a volume of space;

a longitudinal beam positioned between said end-frames and fixedly connected to the top members of each said end-frame such that said longitudinal beam does not move relative to said end-frames;

a plurality of panels for forming two generally upright sides, two floor surfaces and two roof surfaces, said panels stowed essentially within the volume of space defined by said frame; and a plurality of hinges for hingedly attaching the panels and the longitudinal beam into a continuous folding structure, said continuous folding structure being configured for folding into a storage position and for unfolding into a deployed position while maintaining the panels in the continuous folding structure without detaching the panels and without translocating the longitudinal beam.

2. The shelter of claim 1 further comprising:

a flexible surface connected to the ends of at least two panels such that the flexible surface establishes at least a partial closure of the end of the volume of space defined by said panels when they are unfolded outside the volume of space defined by said frame.

3. The shelter of claim 2, further comprising:

a passageway through a portion of a volume of space defined by the panels when they are stowed essentially within the volume of space defined by said frame such that one or more persons may enter the passageway and unfold said panels from within said passageway.

4. The shelter of claim 1 wherein:

said shelter further comprises a flexible surface connected to the end of at least one panel and to the end-frame that is proximate to said end of said panel such that the flexible surface establishes at least a partial closure of the volume of space defined by said panels when they are unfolded outside the volume of space by said frame.

5. The shelter of claim 4, further comprising:

a passageway through a portion of a volume of space defined by the panels when they are stowed essentially within the volume of space defined by said frame such that one or more persons may enter the passageway and unfold said panels from within said passageway.

6. The shelter of claim 1, further comprising:

a passageway through a portion of a volume of space defined by the panels when they are stowed essentially within the volume of space defined by said frame such that one or more persons may enter the passageway and unfold said panels from within said passageway.

7. The shelter of claim 1 further comprising:

a latch mechanism for securing at least one panel to the frame when the panels are unfolded to hold the panels in a secure unfolded position.

8. The shelter of claim 1 further comprising:

mechanical systems for unfolding the panels.

9. The shelter of claim 1 further comprising:

a hoist and cable system for controlling and lowering the panels as they rotate around one of the hinges.

10. The shelter of claim 1 further comprising:

an actuator for forcing the panels apart during the unfolding process to raise at least some of the panels and position the panels to form a roof.

11. A shelter comprising:

a frame comprising two polygon end-frames defining a volume of space, each of said end-frames including a top member and at least two vertical members and at least one longitudinal beam fixedly connected between the top member of each of the end-frames such that the end-frames are opposed to each other and the at least one longitudinal beam does not move relative to said end-frames;

a bottom panel extending between said end-frames;

two top panels with each said top panel having one side hinged to the at least one longitudinal beams and each said top panel having an opposed longitudinal side; and two tri-fold sections each comprising three contiguously hinged panels stowed essentially between the opposing end-frames, wherein one side of each tri-fold section is hinged to one side of said bottom panel and the other side of each tri-fold section is hinged to one of said opposed longitudinal sides of said top panels.

12. The shelter of claim 11 wherein one of three contiguously hinged panels in each of the tri-fold sections comprises a floor surface.

13. The shelter of claim 12 wherein:

said shelter further comprises a flexible surface connected to the end of the panel for forming a floor surface and to the end-frame that is proximate to said end of said panel for forming a floor surface such that the flexible surface establishes at least a partial closure of the volume of space defined by said contiguously hinged panels when they are unfolded outside the volume of space defined by said end-frames.

14. The shelter of claim 11 further comprising:

a flexible surface connected to the ends of at least two contiguously hinged panels such that the flexible surface establishes at least a partial closure of the end of a volume of space defined by said contiguously hinged panels when they are unfolded outside the volume of space defined by said frame.

15. The shelter of claim 11, further comprising:

a passageway through a portion of the volume of space defined by the tri-fold sections when they are stowed essentially within the volume of space defined by said end-frames such that one or more persons may enter the passageway and unfold said tri-fold sections from within said passageway.

16. The shelter of claim 11 further comprising:

a latch mechanism for securing at least one contiguously hinged panel in each tri-fold section to the end-frame when the contiguously hinged panels are unfolded to hold the contiguously hinged panels in a secure unfolded position.

17. A shelter comprising:

a frame comprising two polygon end-frames each of said end-frames including a top member and at least two vertical members and at least one longitudinal beam fixedly connected between the top member of each of the end-frames such that the end-frames are opposed to each other;

a bottom panel extending between said end-frames;

two top panels with each said top panel having one side hinged to the at least one longitudinal beam and each said top panel having an opposed longitudinal side;

a floor panel having an first side and a second side, the first side of the floor panel being hinged to the bottom panel and configured to provide for rotating motion of the floor panel between a vertical position and a horizontal position;

an upright wall portion fixedly attached to the second side of the floor panel and extending obliquely to the floor panel, the upright wall portion having a second side disposed remotely from the floor panel;

a wall panel having a first side and a second side, the first side of the wall panel being hinged to the second side of the upright wall portion, said wall panel being hinged for rotating motion between a position parallel to the floor panel and a position extending obliquely with respect to the floor panel and forming a wall for the shelter; and a roof panel having a first side and a second side, the first side of the roof panel being hinged to the second side of wall panel for motion between a position parallel to and adjacent to the wall panel and a position oblique to the wall panel, substantially parallel to the floor panel and spaced apart from the floor panel to form a roof for the shelter, the second side of the roof panel being hinged to one of the top panels.

18. The shelter of claim 17 further comprising:

a cable system including cables attached for lowering and raising the floor panel between vertical and horizontal positions, a hoist attached to the cable system for extending and retracting cables of the cable system to lower and raise the floor panel.

19. The shelter of claim 18 wherein said hoist is mounted on the floor panel adjacent to the upright wall.

20. The shelter of claim 17 further comprising an actuator connected to raise and lower the wall panel and roof panel.

* * * * *